US008080129B2

(12) United States Patent
Yaqoob et al.

(10) Patent No.: US 8,080,129 B2
(45) Date of Patent: Dec. 20, 2011

(54) ENVIRONMENTALLY BENIGN TCF BLEACHING SEQUENCES FOR AS/AQ WHEAT STRAW PULP

(76) Inventors: Naila Yaqoob, Lahore (PK); Ishtiaq-Ur-Rehman, Lahore (PK); Kausar Jamal Cheema, Lahore (PK); Sahibzada Rashad Hameed, Lahore (PK); Bushra Mateen, Lahore (PK)

( * ) Notice: Subject to any disclaimer, the term of this patent is extended or adjusted under 35 U.S.C. 154(b) by 0 days.

(21) Appl. No.: 12/619,853

(22) Filed: Nov. 17, 2009

(65) Prior Publication Data

US 2011/0114273 A1 May 19, 2011

(51) Int. Cl.
*D21H 11/12* (2006.01)
*D21C 9/16* (2006.01)

(52) U.S. Cl. ..... 162/97; 162/78; 162/82

(58) Field of Classification Search ..... 162/82, 162/97

See application file for complete search history.

(56) References Cited

U.S. PATENT DOCUMENTS

| | | | | |
|---|---|---|---|---|
| 4,404,061 | A * | 9/1983 | Cael | 162/76 |
| 5,246,543 | A * | 9/1993 | Meier et al. | 162/65 |
| 5,589,032 | A * | 12/1996 | Chang et al. | 162/76 |
| 2009/0183845 | A1 * | 7/2009 | Tomoda et al. | 162/60 |

OTHER PUBLICATIONS

Dupont OXONE Monopersulfate Compound, Oct. 2008.*

Mah-e Kamil et al., Pulping of Wheat Straw using Sulfite Process: An experimental Study, 2009, Jorunal of Faculty of Engineering and Technology (pu.edu.pk), vol. 16 No. 1, abstract only.*

* cited by examiner

*Primary Examiner* — Matthew Daniels
*Assistant Examiner* — Anthony Calandra

(57) ABSTRACT

This invention reports an environmentally benign method of delignifying bleaching sequences to gain more than 80% ISO brightness for alkaline sulfite-anthraquinone (AS/AQ) wheat straw pulp comprising of $AOPsYP_0$, $AOPsEP_0$ and $AOPsP_0P_1$ sequences that yielded surprising results in the field of pulp and paper technology; wherein the selectivity of sequences resulted in the protection of α-cellulose from degradation, produced significant drop in acid soluble lignin and yielded low viscosity losses reducing ecological impact of effluent load.

26 Claims, 7 Drawing Sheets

ENVIRONMENTALLY BENIGN TCF BLEACHING SEQUENCES FOR AS/AQ WHEAT STRAW PULP

FIELD OF THE INVENTION

Figure 1:
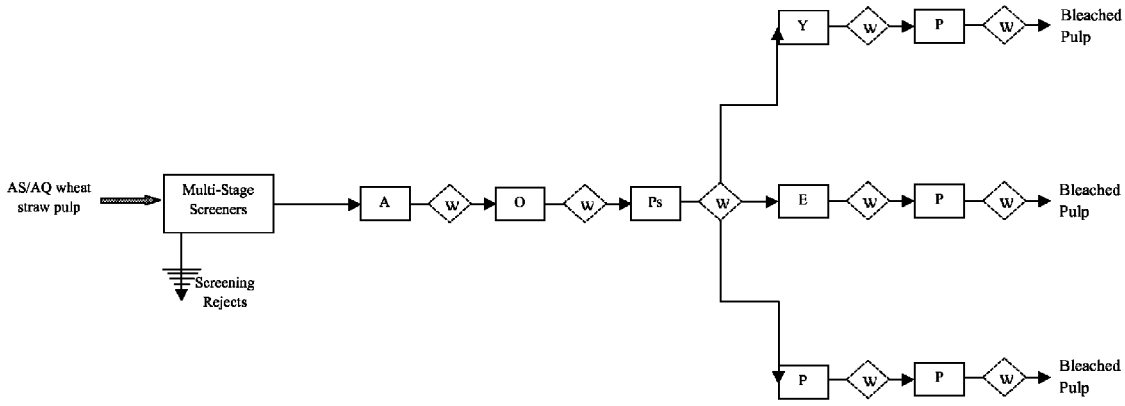

The present invention relates to the design of an environmentally benign total chlorine free (TCF) multistage delignifying bleaching sequences for non-wood AS/AQ (alkaline sulfite-anthraquinone) wheat straw pulp. Commercially available non-chlorinated chemicals have been sequenced into three novel processes to achieve paper of high utility.

BACKGROUND OF INVENTION

Wheat straw represents a large potential source of fiber; which is needed to manufacture paper where wood supply is scarce or expensive. Generally, straw is burned as waste and this results in environmental damage as well as lost of a possible cash crop. Many countries around the world including Pakistan, China, Turkey, Egypt, Spain, India and others use straw pulp to support to manufacture paper because of its ready availability (as industrial waste) and unavailability of wood (lack of enough forests). Since the use of wheat straw requires pulping and bleaching steps, this adds significantly to damaging environment through hazardous effluent discharges that adversely affect the eco-system. Many inventions are thus directly towards reducing the effluent load without affecting consumer supplies but none has fulfilled the gap between the industry need and the requirements of keeping environment clean.

The goal in bleaching chemical pulps is to remove essentially the chromophoric groups (mostly the residual lignin) capable of absorbing visible light. Hypo-bleaching (using hypochlorites and acids), which is significantly damaging to environment, is the traditional approach still practiced because of its effectiveness to fully bleach the pulp at a low cost. However, the pulp quality deterioration and production of hazardous and persistent organochlorines are the major disadvantages in the use of hypochlorite and hypochlorous acid bleaching.

Concerns about the environment and health due to chlorine bleaching resulted in the development of elemental chlorine free (ECF) and totally chlorine free (TCF) bleaching processes. The ECF sequences involve the use of chlorine dioxide that helps reduce the adsorbable organically bound halogens (AOX) while reducing dioxin discharges in wastewaters. The U.S. Pat. No. 5,164,043 to Griggs describes the use of $ClO_2$ as the delignifying and bleaching agent that selectively oxidizes lignin; however, the said invention remains difficult to handle, and exposes paper mill personnel to health hazard.

TCF bleaching involves oxidative degradation of color rendering groups in the pulp. Oxygen, ozone, peroxides and peracids are the most common TCF agents for pulp bleaching but none of the TCF agents is alone capable of bleaching the pulp with full brightness without compromising its properties. TCF bleaching is relatively friendlier to ecology as compared to other bleaching sequences reported so far.

During bleaching, chromophoric groups such as lignin must be degraded and washed away while celluloses are preserved to give structure and strength to the paper. A few studies have reported TCF bleaching sequences for different types of wheat straw pulp [Hedjazi, S. et al 2009; Niu, C. et al 2007 and Wang, H. et al 2003]. The availability of bleaching equipment (e.g., ozone generators) with complete workplace safety equipment and the cost of processing at the production (mill scale) are hurdles in the use of this process. Another practical approach for bleaching is the use of biological enzymes. A few studies on wheat straw recommend the use of enzymatic treatment prior to bleaching; however, the shelf life and cost remain the limitation factors in the complete adoption of this process. Also the enzymes alone have never been reported used to bleach the pulp with full brightness. The incorporation of enzymatic stage in a bleaching sequence is to selectively degrade the lignin contents and ultimately reduce the use of chlorinated or elemental chlorine free chemicals [Tolen et al., U.S. Pat. No. 7,368,036] or TCF sequence [Han, S. et al 2002 and Rancero, M. B. et al 2003].

The various processes of papermaking involve comparable steps except the choice of pulping and bleaching chemicals and their sequences for application in light of different composition of lingo-cellulosic contents of the raw materials used for paper making. The sequence of treatment developed for one type of fibrous pulp may not prove be applicable to other types, leaving a large unmet need for the development of new and improved bleaching strategies to treat different pulp varieties.

The present invention reports selective and efficient bleaching sequences for AS/AQ wheat straw pulp where the conventional bleaching agents have been utilized in such a way that the amounts used, the reacting conditions employed and the sequences applied proved the preservation and protection of every type of pulp and paper properties with very low effluent load.

REFERENCES

Hedjazi, S. et al., "Alkaline Sulphite-anthraquinone (AS/AQ) pulping of wheat straw and totally chlorine free bleaching of pulps", *Industrial crops and products,* 29 (1): 27-36 (2009)

Niu, C. et al., "A study on the short sequence of totally chlorine free bleaching of wheat straw soda—AQ pulp", *Zhonghua Zhiye,* 28 (8): 43-47 (2007)

Wang, H. et al., "Strengthened ozone-TCF bleaching of low-kappa number wheat straw pulp", *Zhonghua Zhiye,* 22 (8): 9-12 (2003)

Han, S. et al., "TCF bleaching properties of wheat-straw pulps pre-treated by enzyme in a laccase-mediator system", *linchan Huaxue Yu Gongye,* 22 (4): 5-9 (2002)

Rancero, M. B. et al., "TCF bleaching of wheat straw pulp using ozone and xylanase, Part A: Paper Quality Assessment", *Bioresource Technology,* 87 (3): 305-314 (2003)

SUMMARY OF INVENTION

The invention comprises of multistage TCF bleaching sequences (FIG. 1) for delignifying bleaching of AS/AQ wheat straw pulp to achieve a high quality paper and to significantly reduce the bleaching-effluent load.

Prior to the beginning of treatment sequence, shives (non/semi-bleachable pulp components) are removed from the AS/AQ pulp. The next step is the removal of metal ions from the straw pulp. Iron is the most crucial among the metals for the wheat straw; and its presence reduces the selectivity of bleaching responses towards pulp. Thus acidic pre-treatment is carried out to remove the metal residues of the straw pulp as much as possible without inducing significant degradation of pulp. The next step is oxygen delignification in alkaline media to degrade lignin contents followed by extended delignifying bleaching using aqueous solution of commercially available inorganic salt, oxone (Ps). Further comprised of three different embodiments optimized as additional bleaching steps to AOPs-stage AS/AQ straw pulp to achieve the brightness>80% ISO:

- $YP_0$ i.e., Incorporation of reductive sequence prior to peroxide treatment: ISO Brightness 82.0%, acid insoluble lignin 1.12% and CED viscosity 10.60 Cp
- $EP_0$ i.e., A conventional extraction stage prior to peroxide treatment: ISO Brightness 82.5%, acid insoluble lignin 0.7% and CED viscosity 11.93 Cp
- $P_0P_1$ i.e., Two consecutive peroxide stages: Brightness 81.6%, acid insoluble lignin 1.02% and CED viscosity 11.90 Cp Washing step follows every stage in each of the developed sequences. Three different embodiments as addition bleaching steps results in three sequence options: $AOPsYP_0$, $AOPsEP_0$ and $AOPsP_0P_1$ where all are effective in removal of lignin at large and protecting cellulose fiber from damaging with different bleaching agents.

BRIEF DESCRIPTIONS OF THE DRAWINGS

FIG. 1 Flow sheet of the developed TCF bleaching sequences

Figure 2:
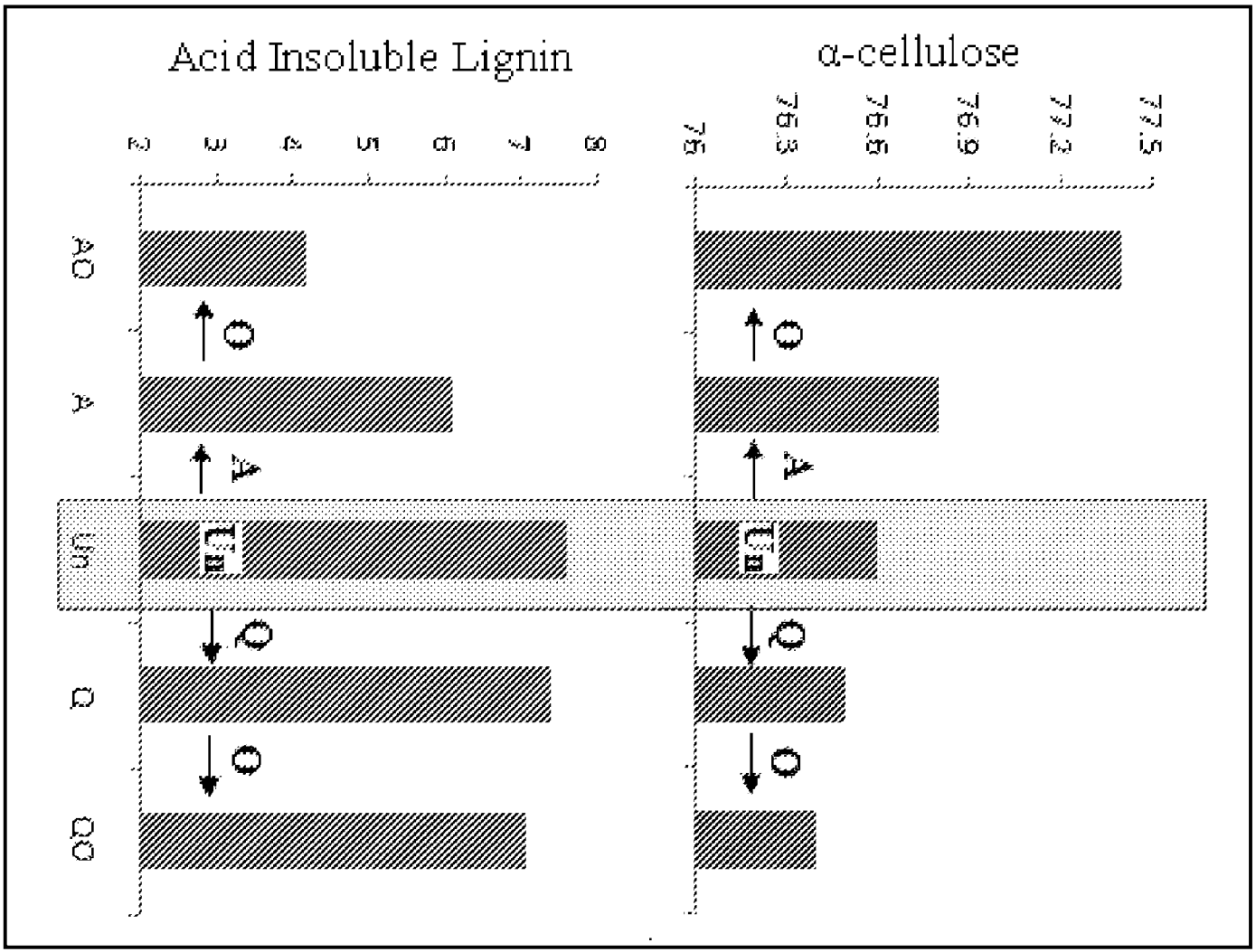

FIG. 2 Selectivity towards delignification in terms of % decrease in acid soluble lignin and % increase of α-cellulose for acid (A) and EDTA (Q) pre-treated AS/AQ wheat straw pulp.

Figure 3:
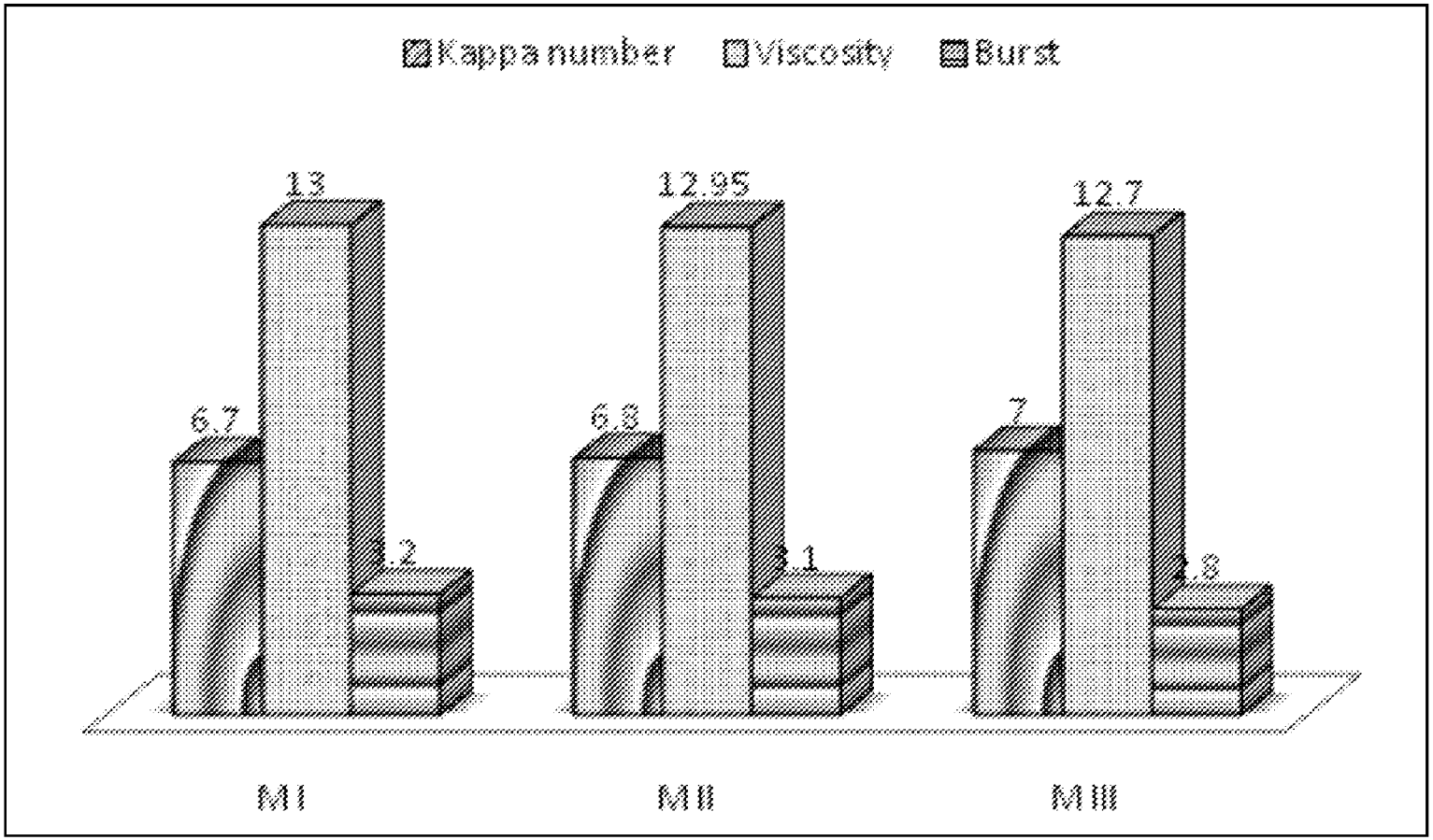

FIG. 3 Effectiveness of chemical additive sequence during O-treatment where M I represents addition of $MgCO_3$ solution followed by NaOH solution addition; MII represents combined addition of solutions of $MgCO_3$ and NaOH and MIII represents addition of NaOH solution followed by $MgCO_3$ solution addition FIG. 4 AS/AQ wheat straw pulp exposures to dithionite (Y): Yellowness (CIE %) verses time and temperature.

Figure 5:
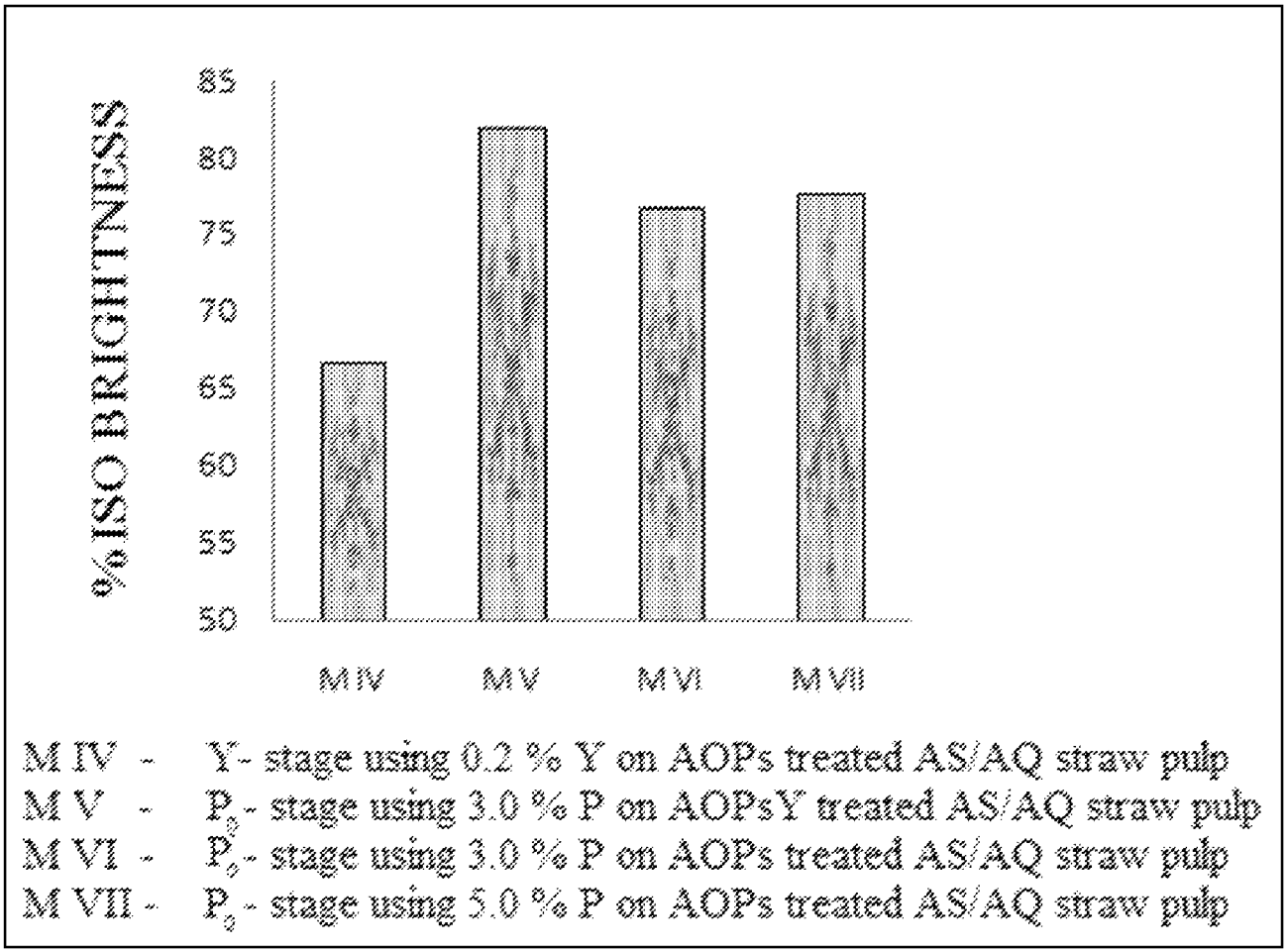
Figure 6:
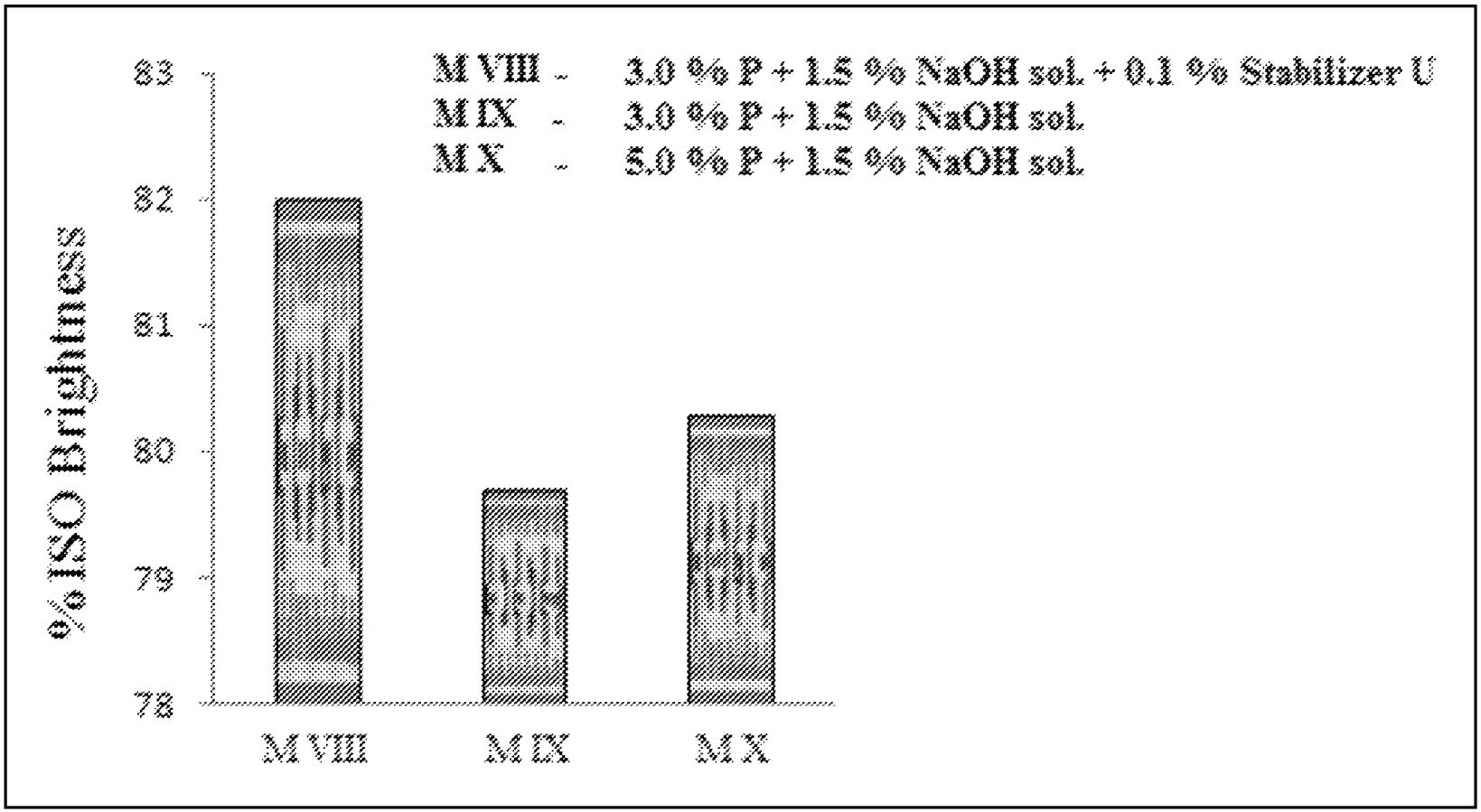
Figure 7:
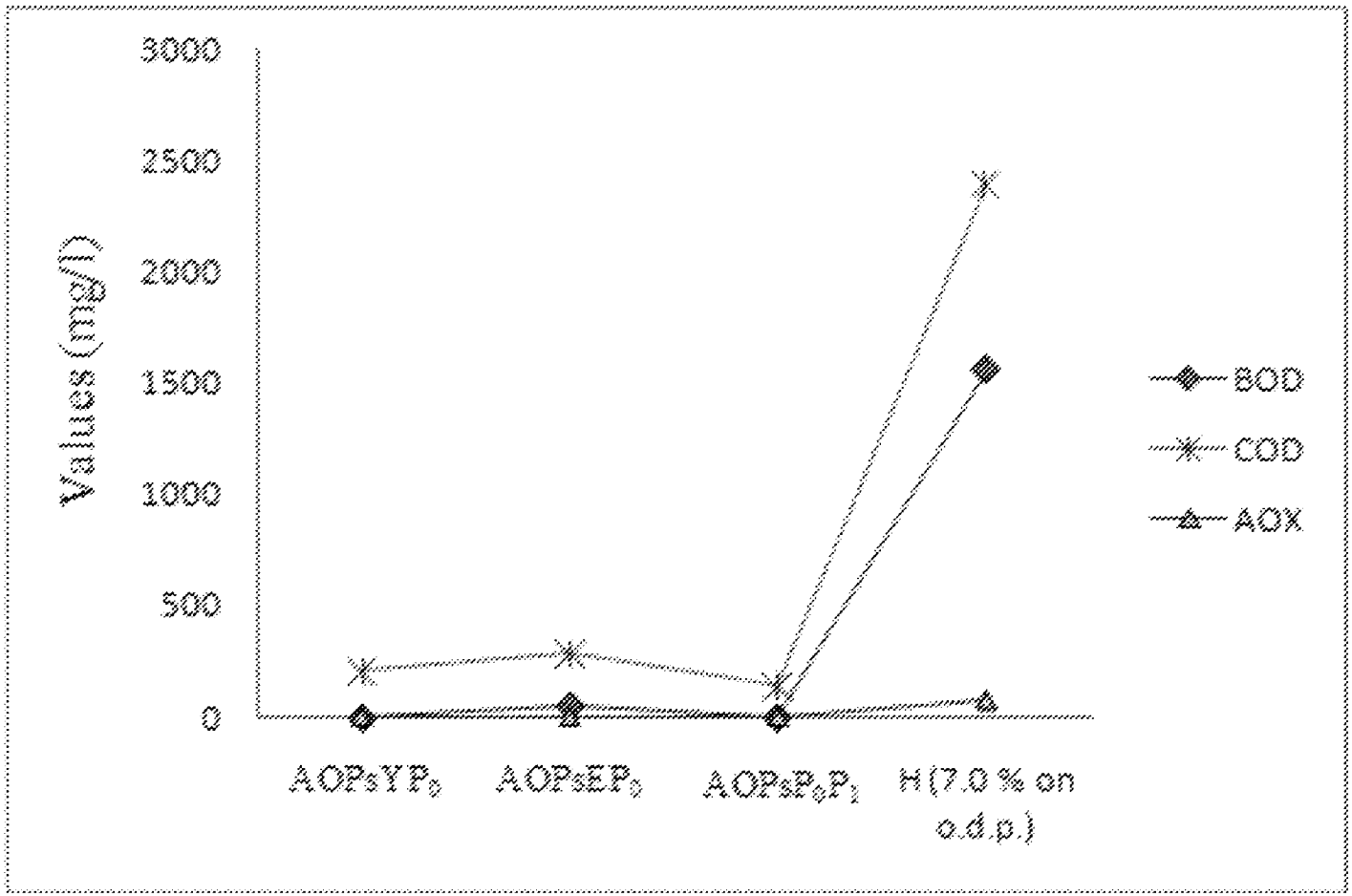

FIG. 5 Advantage of incorporating Y stage in $AOPsYP_0$ sequence towards reducing the peroxide consumption FIG. 6 Advantage of utilization of stabilizer U towards brightness increase in peroxide bleaching stage FIG. 7 Load comparison of effluents for Hypo (H) verses TCF bleaching sequences: $AOPsYP_0$, $AOPsEP_0$ and $AOPsP_0P_1$

DETAILED DESCRIPTION OF THE PREFERRED EMBODIMENT

The letters, abbreviation or terms used to express bleaching and/or other embodiments are described as follows:

A—Acidification
O—Oxygen delignification
Ps—Oxone
E—Alkaline extraction
Y—Sodium dithionite
P—Peroxide
$P_0$—$1^{st}$ stage Peroxide
$P_1$—$2^{nd}$ stage Peroxide
Q—Chelating agent
H—Hypo-bleaching (Calcium hypochlorite)
W—Wash water
Un—unbleached AS/AQ wheat straw pulp
TCF—Total chlorine free
AS/AQ—Alkaline sulfite-anthraquinone; AS/AQ wheat straw pulp used for this invention was prepared under conditions described in Table I:

TABLE I

AS/AQ pulping Conditions

| Chemical doses on oven dried pulp | pressure | Temp. | Time |
|---|---|---|---|
| 14.0% sodium sulphite<br>0.05% anthraquinone<br>0.025% Surfactant | 145-160 psi | 180-185° C. | 45 min. |

Consistency—Concentration of pulp suspensions in water calculated as: [percent consistency={(weight of oven-dried pulp specimen/net weight of original pulp specimen)×100}]
Medium Consistency—ranges usually 6-20%
CED viscosity—Viscosity of 0.5% cellulose solution, using 0.5 M cupriethylenediamine as a solvent
Kappa Number—Determination of the relative hardness, bleachability, or degree of delignification of the pulp
Brightness—Numerical value of the blue reflectance factor of the handsheets
Whiteness—Extent to which paper reflects light of all wavelengths throughout the visible spectrum
Yellowness—Degree of discoloration of pulp
Opacity—Property of the paper which governs the extent to which one sheet of paper visually obscures printed matter on the underlying sheet of similar paper
Grammage—Density of paper in grams per square meter
Bulk—Flexibility of printing paper and is the physical thickness of the piece of a paper in relation to its weight
Tear Index—Tearing resistance of a paper sheet divided by its grammage
Tensile Index—Rupturing of test paper piece stretched at constant rate of elongation with respect to its grammage
Burst Index—Maximum hydrostatic pressure required to produce rupture in a test specimen with respect to its grammage
Elongation—Percentage of tensile strain produced in test specimen before rupture
Caliper—Thickness of paper
Porosity—Measure of total circulating air voids in a sheet structure. It is highly important in determining the printability on a paper sheet.

Standard methods used throughout the process are cited in Table II.

TABLE II

Standard Methods used During this Process

| Tests | International standard methods |
|---|---|
| CED Viscosity | TAPPI Method: T 230 om-94 |
| Kappa Number | TAPPI Method: T 236 cm-85 |
| α-cellulose | TAPPI Method: T 230 cm-99 |
| Consistency | TAPPI Method: T 240 om-93 |
| Formation of Handsheets | TAPPI Method: T 205 sp-95 |
| Brightness | TAPPI Method: T 452 om-98 |
| Grammage | ISO Method: ISO 536: 1995 (E) |
| Burst Index | TAPPI Method: T 403 om-97 |
| Tensile Index | ISO Method: ISO 1924-2: 1994 (E) |
| Tear Index | ISO Method: ISO 1974: 1990 (E) |
| Caliper | TAPPI Method: T 411 om-97 |
| Bulk | ISO Method: 534: 1998 (E) |
| Acid Insoluble Lignin | TAPPI Method: T 222 om-98 |

DETAILED DESCRIPTION OF THE INVENTION

This invention provides bleaching sequences comprised of environmentally benign total chlorine free oxidative and/or reductive reagents. AS/AQ wheat straw pulp cooked at the conditions described in the Table 1 showed the values ISO brightness: 43.9%, Kappa number: 12.4, CED viscosity: 13.1 Cp, acid insoluble lignin: 7.6%, α-cellulose: 76.6% and burst index: 2.8 $kPa \cdot m^2 g^{-1}$.

Shives are fibrous bundles in straw pulp, which are responsible for reducing the strength and runnability of unbleached pulp and appear as dust particles in bleached paper. To prepare the unbleached AS/AQ pulp, it was screened through 0.15 mm slot screen reduce the shive contents as much as possible. Dewatering the pulp to medium consistency and then acidification thereafter followed the de-shiving.

A-Treatment

Acidification of the wheat straw pulp comprised the doses of 0.5% to 2.0% of 4.0 N sulfuric acid on oven dried pulp basis, preferably 2.0% on oven dried pulp; consistency may range from 10.0 to 30.0% (15.0% optimized due to increased in % ISO brightness) while the treatment was selected to be carried out at ambient temperature for 10-15 minutes. The effects of temperature rage 25° C. to 75° C. and time 10 to 30 minutes were investigated on straw pulp. Any increase in ambient temperature and delay in treatment time period decreased the pulp brightness, which is set forth as primary target to decide on the preferred condition for the entire processes involved in bleaching sequences (Table II). Acid solubilized the sequestered metals of wheat straw pulp helped reduce the kappa number and lignin. Along with this, the pulp brightness also increased during acid treatment.

TABLE III

Conditions of Acidification and Chelation

| Treatment | pulp consistency | % of chemicals on o.d.p | Temp. | Time |
|---|---|---|---|---|
| A | 15.0% | 2.0% $H_2SO_4$ | Ambient temp: (25-35° C.) | 10-15 min. |
| Q | 3.0% | 1.0% EDTA | 80° C. | 60.0 min. |

The presence of metal ions catalyses the cellulose degradation and discolors the pulp. FIG. 2 describes that the mild pre-treatment of wheat straw pulp with sulfuric acid resulting in more selectivity towards delignification when oxygen treated, by retarding cellulose degradation as compared to conventional EDTA chelation (Q). Metal removal also preserves the pulp strength properties during oxygen delignification. Acid is a preferred pre-treatment method for this invention over EDTA because of its ability of removing 90% iron from AS/AQ wheat straw pulp as compared to chelating agent that removes only 25% iron.

Both the A and Q treated AS/AQ wheat straw pulps were washed with distilled water to neutral pH to avoid any further addition of metal ions from fresh/washed water. The water-washed pulp was pressed to medium consistency preferably >10.0%.

O-Treatment

In this treatment, the pulp is directed to a revolving digester for oxygen delignification, where the process is carried out at 10.0% consistency and comprised of the addition and homogenous distribution of aqueous solution of $MgCO_3$ to pulp fiber followed by the addition and homogenous mixing of aqueous solution of NaOH. Oxygen was then fed after about 5 to 10 minutes at 70 to 75 psi gauge pressure and the process was then continued for 60 minutes in continuous circulating closed loop digester (Table IV).

TABLE IV

Conditions for oxygen delignification

| Pulp consistency | Oxygen pressure | Percentage of chemicals on oven dried pulp | Temp. | Time |
|---|---|---|---|---|
| 10.0% | 70-75 psi | 2.0% NaOH<br>0.3% $MgCO_3$ | 100° C. | 60 min. |

FIG. 3 describes the addition of $MgCO_3$ solution to AS/AQ pulp fiber before NaOH solution addition and it was found more effective for delignification during O-treatment and protection of other pulp properties such as viscosity, strength etc. The selection of either $MgCO_3$ or $MgSO_4$ for delignification process does not necessarily affect the pulp properties as that the brightness is increased by only 1 unit % ISO when $MgCO_3$ is preferred for the process. By following the presented method up to this stage in this invention, kappa number of the pulp was reduced to approximately 38% with reference to A-treated pulp (~46% overall reduction in kappa number) with essentially no damage to cellulose component of pulp which is also evident from the CED viscosity results (Table IX).

The delignified pulp is washed to remove the solubilized lignin contents due to oxygen treatment and pressed to consistency>10%.

Ps-Treatment

This step of invention comprises of extended delignification and bleaching of AO treated AS/AQ pulp with commercially available product: oxone (Ps) in which peroxymonosulphate is an active agent for the reaction. Oxone treatment comprises of the addition of 0.5-10.0% alkali and 3.0-7.0% oxone charge.

Increasing the alkali dose from 0.5-1.0-1.5% dose slightly effects the brightness from 64.5% to 64.8% to 65.1% ISO respectively. Further alkali addition reduces the brightness percent ISO. No significant brightness jump is observed beyond this alkali consumption; thus the dose preferred for this stage is 0.5%. Absence of alkali in Ps-stage shows>7.0 units decreased brightness level (57.2% ISO) as compared to Ps-stage with 0.5% alkali.

Oxone charge for the Ps-treatment may range from 3.0 to 10.0% on oven dried pulp; but increasing the charge in the presence of 0.5% alkali from 3.0 to 5.0% aqueous oxone solution on oven dried pulp increases the brightness by two units while further increase from 5.0%-10.0% oxone charge on oven dried pulp increases the brightness by only about <0.4 units of ISO brightness.

Ali et al. patent (U.S. Pat. No. 5,656,130) describes the use of peroxyacid salts at temperature (~20° C. to 50° C.) to pulp bleaching mill after conventional bleaching stages to further increase the brightness without substantial loss in pulp fiber strength. While practicing the present invention an elevated temperature of 65° C. is preferred to increase the selectivity of oxone towards lignin removal. The Ps-treatment can be carried out at fairly flexible temp. (Ambient-95° C.), time (30-180 min.) and consistency (5%-35%) ranges. Preferred Ps-treatment conditions are mention herein as Table V:

TABLE V

| Conditions for Ps-treatment | | | | |
|---|---|---|---|---|
| Pulp consistency for Ps-treatment | Aqueous OXONE solution charge on oven dried pulp | Aqueous alkali dose | Temp. | Time |
| 10.0% | 5.0% | 0.5% NaOH | 65° C. | 30 min. |

A further 23.3% decrease in acid insoluble lignin contents was found with CED viscosity 12.90 Cp (further loss of 0.76%) without α-cellulose degradation and brightness level of 64.5% ISO.

Ps-treated pulp was again washed and pressed by conventional method to increase the consistency>10.0%.

Ps-treated pulp AOPs-staged pulp was then bleached further by following the sequence routes mentioned herewith:

| | |
|---|---|
| Reductive-Oxidative | $YP_0$ |
| Extraction-Oxidative | $EP_0$ |
| Oxidative-Oxidative | $P_0P_1$ |

$YP_0$-Treatment $YP_0$-treatment comprises of two stages each followed by washing to remove soluble products and extractives formed during bleaching. Sodium dithionite (Y) is used as reductive reaction step in one of the bleaching sequences AOPs$YP_0$ of this invention.

TABLE VI

| Bleaching Conditions for Y stage | | | |
|---|---|---|---|
| Pulp consistency for Y-treatment | Dithionite solution on oven dried pulp | Temp. | Time |
| 3.0% | 0.2% | 70° C. | 30 min. |

Figure 4:
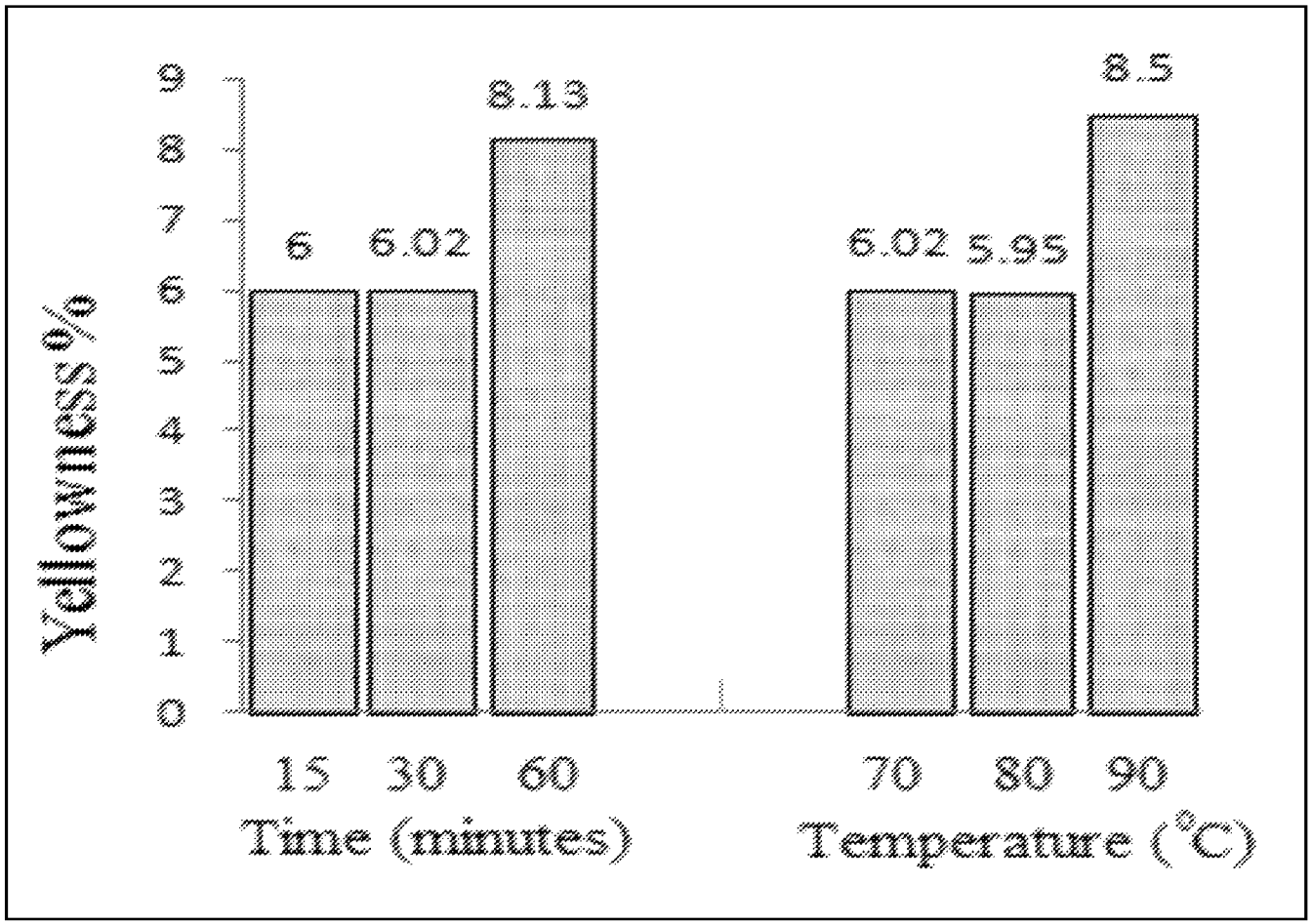

The sensitive embodiments of this step are the temperature and time. Temperature range (60° C.-70° C.) is the more crucial towards brightness increase. Lower temperature range practically leave no impact on pulp optical properties; while 70° C.-80° C. does not results in considerable brightness increase (FIG. 4). Increasing the temperature beyond 80° C. starts degrading dithionite which does not show any practical advantage in terms of brightness rather yellowing of paper starts.

Likewise, the increased time of pulp exposure to dithionite also leads to its coloration (FIG. 4). Preferred reaction time for this stage is opted to be 30 minutes after which the pulp is immediately washed to avoid any loss in stability of dithionite and pulp coloration. Y-stage increases the brightness by only 2.3 units with reference to the AOPs stage-treated pulp (66.8% ISO); but FIG. 5 describes this Y-treatment prior to peroxide reduces the consumption of costly hydrogen peroxide for pulp bleaching as well as increases the pulp final brightness.

Air contact may lead to the poor dithionite performance; even then the conventional bleaching equipment performs well by the use of low consistency pulp as low consistency itself minimizes the air mixing with pulp.

The $P_0$-stage (Table VII) herein comprises of the addition aqueous solution of alkali and stabilizer U followed by hydrogen peroxide addition.

TABLE VII

| Bleaching Conditions for Hydrogen Peroxide | | | | |
|---|---|---|---|---|
| Pulp consistency for $P_0$-stage | $H_2O_2$ charge on oven dried pulp | Chemical doses on oven dried pulp | Temp. | Time |
| 10.0% | 3.0% | 1.5% NaOH solution<br>0.1% Stabilizer U | 90° C. | 60 min. |

Stabilizer U is a silicate free commercial product (Peroxide Stabilizer: Universal Chemical Industries, Karachi, Pakistan), having its application in textiles to bleach fabrics with peroxide. Its use in this invention is to scavenge active oxygen of hydrogen peroxide and to make it available for pulp only; thus lowering the consumption of hydrogen peroxide during bleaching (FIG. 6).

While optimizing alkali dose in the P-stage in the presence of stabilizer U and peroxide, brightness values preferred the selection of 1.5% alkali for this $P_0$-stage. Any further increase beyond this dose does not significantly increase pulp brightness. Conventionally used temperature (90° C.) and time (1.0 hr.) are effective and used for this stage bleaching.

$EP_0$-Treatment $EP_0$-treatment also comprises of two stages: alkaline extraction (E) and oxidative/hydrogen peroxide ($P_0$) stage, each followed by washing. Like Y-stage in $YP_0$-treatment incorporation of E-stage in replacement to Y-stage is another option to improve the final stage brightness of AOPs treated pulp and to reduce the load of hydrogen peroxide consumption on pulp. E-stage utilizes conventional conditions of extraction only (Table VIII).

TABLE VIII

| Conditions for alkaline extraction | | | |
|---|---|---|---|
| Pulp consistency for E-Stage | Aqueous alkali solution on oven dried pulp | Temp. | Time |
| 10.0% | 3.0% | 70° C. | 120 min. |

Alkaline extracted washed pulp follows hydrogen peroxide bleaching at conditions described in Table VII and then washing where [AOPs$EP_0$] shows the targeted brightness of 80+(82.5% ISO).

$P_0P_1$-Treatment $P_0P_1$-Treatment is a two-stage hydrogen peroxide treatment each stage followed by washing. Single stage hydrogen peroxide treatment is not found to be effective to achieve 80+% ISO brightness. Multiple peroxide stages not only reduce the consumption load of chemical but also help to increase the brightness. Conditions for peroxide stages are the same as mentioned in Table VII with only difference that $P_1$-stage uses only 2.0% hydrogen peroxide as compared to $P_0$ which uses 3.0% hydrogen peroxide on oven dried pulp basis.

Table IX shows the selectivity of the sequences throughout the bleaching stages of AOPs$YP_0$, AOPs$EP_0$ and AOPs$P_0P_1$ sequences as protectors to the celluloses in AS/AQ wheat straw pulp where acid soluble lignin gradually washes away to negligible level which is also supported by the kappa number values of each sequence; and the α-cellulose (%) contents surprisingly enhanced to some extent as compared to the conventional approaches where bleaching process degrades the cellulose contents.

TABLE IX

Chemical Characteristics of AS/AQ Wheat Straw Pulp and Paper

| Stage | Bleach Status | Kappa Number ± SD* | α-Cellulose (%) ± SD* | Acid Insoluble Lignin (%) ± SD* | CED Viscosity (Cp) ± SD* |
|---|---|---|---|---|---|
| Un | Un | 12.4 ± 0.49 | 76.6 ± 0.90 | 7.6 ± 0.40 | 13.10 ± 0.11 |
| A | A | 10.8 ± 0.59 | 76.8 ± 0.92 | 6.1 ± 0.26 | 13.28 ± 0.19 |
| O | AO | 6.70 ± 0.21 | 77.4 ± 1.63 | 4.2 ± 0.36 | 13.00 ± 0.20 |
| Ps | AOPs | 2.09 ± 0.03 | 77.1 ± 1.47 | 3.22 ± 0.15 | 12.90 ± 0.13 |
| Y | AOPsY | — | 77.1 ± 1.53 | 3.13 ± 0.11 | 12.70 ± 0.09 |
| $P_0$ | $AOPsYP_0$ | — | 77.5 ± 1.79 | 1.12 ± 0.09 | 10.60 ± 0.17 |
| E | AOPsE | — | 77.2 ± 1.44 | 1.23 ± 0.14 | 12.33 ± 0.13 |
| $P_0$ | $AOPsEP_0$ | — | 81.2 ± 3.58 | 0.7 ± 0.08 | 11.93 ± 0.17 |
| $P_0$ | $AOPsP_0$ | — | 78.7 ± 2.19 | 2.01 ± 0.13 | 12.43 ± 0.15 |
| $P_1$ | $AOPsP_0P_1$ | — | 79.5 ± 3.01 | 1.02 ± 0.10 | 11.90 ± 0.08 |

*SD = Standard deviation

Other physical data of AS/AQ wheat straw bleached pulp samples are also described (Table X). All the physical properties of bleached AS/AQ wheat straw pulp results in values that are highly demanding to make business/office paper.

TABLE X

Physical Characteristics of AS/AQ Wheat Straw Pulp and Paper

| | Unbleached | Bleached | | |
|---|---|---|---|---|
| | (Un) | $AOPsYP_0$ | $AOPsEP_0$ | $AOPsP_0P_1$ |
| Parameters | | | | |
| Grammage ($g \cdot m^{-2}$) | 72.6 | 68.8 | 69.1 | 69.1 |
| Bulk ($cc \cdot g^{-1}$) | 1.96 | 1.63 | 1.58 | 1.62 |
| Caliper (μ) | 142 | 112 | 109 | 112 |
| Elongation (%) | 2.41 | 4.03 | 5.01 | 3.17 |
| Burst Index ($kPa \cdot m^2g^{-1}$) | 2.8 | 2.8 | 3.2 | 4.1 |
| Tear Index ($mN \cdot m^2g^{-1}$) | 3.8 | 6.8 | 6.8 | 5.1 |
| Tensile Index ($Nm \cdot g^{-1}$) | 61.3 | 41.3 | 43.8 | 71.2 |
| Optical | | | | |
| Brightness (%) | 43.9 | 82.0 | 82.5 | 81.6 |
| Yellowness (%) | 19.3 | 1.89 | 1.48 | 1.98 |
| Whiteness (CIE %) | 1.1 | 62.00 | 61.70 | 57.8 |
| Opacity (%) | 91.8 | 80.20 | 80.70 | 79.7 |
| Others | | | | |
| Yield (%) | — | 99.4 | 94.2 | 93.6 |
| Porosity ($ml \cdot min^{-1}$) | 180/213 | 380/423 | 383/428 | 235/305 |

Evidence for Environmentally Benign Process

Every stage in each sequence comprises of totally chlorine free chemicals. Mild bleaching conditions are preferred through out of the processes. BOD of each final sequence is negligible. COD also shows considerable reduction as compared to hypo bleach pulp. Adsorbable organically bound halogens (AOX) which are the most crucial for any pulp and paper mill are kept at zero by using non-halogenated agents for bleaching throughout the processes of this invention as compared to hypo-bleaching (H) which imports huge carcinogenic load into pulp and paper mill effluents in the form of AOX. Thus all the three sequences of this invention for bleaching process are environmentally benign (FIG. 7) and will also help to reduce the cost on effluent treatment plant processes.

What is claimed is:

1. A method of delignifying bleaching of alkaline-sulphite anthraquinone (AS/AQ) wheat straw pulp labelled as $AOPsYP_0$ comprising the steps of:

(a) Mechanical pressing of pulp to consistency greater than 15%;

(b) Acidification (A) with 2.0% sulphuric acid on the oven dried pulp;

(c) First wash with distilled water until the pulp shows neutral pH;

(d) Mechanical pressing of pulp to consistency greater than 10%,;

(e) Delignification by oxygenation (O) using pure oxygen feed at 70-75 psig pressure in a revolving closed loop digester;

(f) Second wash with distilled water until the pulp shows neutral pH;

(g) Mechanical pressing of the pulp to consistency greater than 10%;

(h) Extended delignification and bleaching with 5.0% potassium peroxymonopersulfate (Ps) concentration on the oven dried pulp;

(i) Third wash with distilled water until the pulp shows neutral pH;

(j) Mechanical pressing of pulp to consistency greater than 10;

(k) Reductive bleaching step (Y) using 0.2% sodium dithionite on oven dried pulp;

(l) Fourth wash with distilled water until the pulp shows neutral pH;

(m) Mechanical pressing of pulp to consistency greater than 10%;

(n) Oxidative bleaching using 3.0% hydrogen peroxide ($P_0$) on the oven dried pulp;

(o) Fifth wash with distilled water until the pulp shows neutral pH.

2. A method of delignifying bleaching of alkaline-sulphite anthraquinone (AS/AQ) wheat straw pulp labelled as $AOPsEP_0$ comprising the steps of:

(a) Mechanical pressing of pulp to consistency greater than 15%;

(b) Acidification (A) with 2.0% sulphuric acid on the oven dried pulp;

(c) First wash with distilled water until the pulp shows neutral pH;

(d) Mechanical pressing of the pulp to consistency greater than 10%;

(e) Delignification by oxygenation (O) using pure oxygen feed at 70-75 psig pressure in a revolving closed loop digester;

(f) Second wash with distilled water until the pulp shows neutral pH;

(g) Mechanical pressing of the pulp to consistency greater than 10%;

(h) Extended delignification and bleaching with 5.0% potassium peroxymonopersulfate (Ps) concentration on the oven dried pulp;

(i) Third wash with distilled water until the pulp shows neutral pH;

(j) Mechanical pressing of the pulp to consistency greater than 6%;

(k) Conventional alkaline extraction (E) using 3.0% sodium hydroxide on the oven dried pulp;

(l) Fourth wash with distilled water until the pulp shows neutral pH;

(m) Mechanical pressing of the pulp to consistency greater than 10%;

(n) Oxidative bleaching using 3.0% hydrogen peroxide ($P_0$) on the oven dried pulp;

(o) Fifth wash with distilled water until the pulp shows neutral pH.

3. A method of delignifying bleaching of alkaline-sulphite anthraquinone (AS/AQ) wheat straw pulp labelled as AOPs$P_0$ $P_1$ comprising the steps of:

(a) Mechanical pressing of the pulp to consistency greater than 15%;

(b) Acidification (A) with 2.0% sulphuric acid on the oven dried pulp;

(c) First wash with distilled water until the pulp shows neutral pH;

(d) Mechanical pressing of the pulp to consistency greater than 10%, preferably between 15% and 20%;

(e) Delignification by oxygenation (O) using pure oxygen feed at 70-75 psig pressure in a revolving closed loop digester;

(f) Second wash with distilled water until the pulp shows neutral pH;

(g) Mechanical pressing of the pulp to consistency greater than 10%;

(h) Extended delignification and bleaching with 5.0% potassium peroxymonopersulfate (Ps) concentration on the oven dried pulp;

(i) Third wash with distilled water until the pulp shows neutral pH;

(j) Mechanical pressing of the pulp to consistency greater than 10%;

(k) Oxidative bleaching using 3.0% hydrogen peroxide ($P_0$) on the oven dried pulp;

(l) Fourth wash with distilled water until the pulp shows neutral pH;

(m) Mechanical pressing of the pulp to consistency greater than 10%;

(n) Oxidative bleaching using 2.0% hydrogen peroxide ($P_1$) on the oven dried pulp;

(o) Fifth wash with distilled water until pulp shows neutral pH.

4. The method in the claim 1, wherein said reductive bleaching step (Y) with dithionite is conducted at 70° C. temperature.

5. The method in the claim 1, wherein said dithionite bleaching (Y) is conducted for 30 minutes.

6. The method in the claim 1, wherein said dithionite bleaching (Y) is carried out at 3.0% pulp consistency.

7. The method in claim 2, wherein said alkaline extraction (E) is conducted at 70° C.

8. The method in claim 2, wherein said alkaline extraction (E) is conducted for 120 minutes.

9. The method in claim 2, wherein said alkaline extraction (E) is conducted at 10% consistency.

10. The method of claim 1, 2 or 3, wherein said AS/AQ wheat straw pulp is sieved through 0.15 mm slot screen to remove shives prior to start of said delignifying bleaching.

11. The method in the claim 1, 2 or 3, wherein said acidification is performed at ambient temperature ranging between about 25-35° C.

12. The method in the claim 1, 2 or 3, wherein said acidification is conducted for a period ranging between 10-15 minutes.

13. The method in the claim 1, 2 or 3, wherein said acidification is conducted at 15% consistency.

14. The method in the claim 1, 2 or 3, wherein said delignification by oxygen (O) is performed at 100° C.

15. The method in the claim 1, 2 or 3, wherein said oxygen delignification (O) is conducted for a period of 60 minutes.

16. The method in the claim 1, 2 or 3, wherein said oxygen delignification (O) is conducted at 10% consistency.

17. The method in the claim 1, 2 or 3, wherein said delignification by oxygen (O) is conducted in an alkaline medium comprising the addition of a first solution of 0.3% magnesium carbonate followed by a second solution of 2.0% sodium hydroxide on the basis of oven dried pulp weight.

18. The method in the claim 1, 2 or 3, wherein said extended delignification and bleaching (Ps) is conducted in the presence of 0.5% sodium hydroxide based on oven dried pulp.

19. The method in the claim 1, 2 or 3, wherein said extended delignification and bleaching stage (Ps) is conducted at 65° C.

20. The method in the claim 1, 2 or 3, wherein said extended delignification and bleaching (Ps) is conducted for 30 minutes.

21. The method in the claim 1, 2 or 3, wherein said extended delignification and bleaching stage (Ps) is conducted at 10% consistency.

22. The method in the claim 1, 2 or 3, wherein said oxidative bleaching with hydrogen peroxide is carried out in presence of 1.5% sodium hydroxide and 0.1% concentration of a silicate-free hydrogen peroxide stabilizer on oven dried pulp.

23. The method in the claim 1, 2 or 3, wherein said oxidative bleaching with hydrogen peroxide is conducted at 90° C.

24. The method in the claims 1, 2 or3, wherein said oxidative bleaching with hydrogen peroxide is conducted for 60 minutes.

25. The method in the claim 1, 2 or 3, wherein said oxidative bleaching with hydrogen peroxide is conducted 10% consistency.

26. The method in the claim 1, 2 or 3, wherein said bleaching sequence yields a pulp with a brightness level of greater than 80% ISO and acid insoluble lignin of less than 2%.

* * * * *